US006851252B2

(12) United States Patent
Mäki-Rahkola et al.

(10) Patent No.: US 6,851,252 B2
(45) Date of Patent: Feb. 8, 2005

(54) FILM FEEDING DEVICE AND AN AUTOMATIC WRAPPING DEVICE

(75) Inventors: Hannu Mäki-Rahkola, Pantane (FI); Jari Mäki-Rahkola, Kauhajoki (FI); Tapio Tuomiranta, Kurikka (FI)

(73) Assignee: PESMEL Oy, Kauhajoki (FI)

( * ) Notice: Subject to any disclaimer, the term of this patent is extended or adjusted under 35 U.S.C. 154(b) by 0 days.

(21) Appl. No.: 10/425,318

(22) Filed: Apr. 29, 2003

(65) Prior Publication Data

US 2003/0200732 A1 Oct. 30, 2003

(30) Foreign Application Priority Data

Apr. 30, 2002 (FI) ..... 20020814

(51) Int. Cl.[7] ..... B65B 11/00
(52) U.S. Cl. ..... 53/588; 53/168; 53/204
(58) Field of Search ..... 53/588, 210, 556, 53/168, 204, 589; 100/27, 28

(56) References Cited

U.S. PATENT DOCUMENTS

| | | | | | |
|---|---|---|---|---|---|
| 4,185,442 | A | * | 1/1980 | Johnson et al. | 53/168 |
| 4,400,928 | A | * | 8/1983 | Watanabe | 53/168 |
| 4,614,075 | A | * | 9/1986 | Focke et al. | 53/168 |
| 4,905,457 | A | * | 3/1990 | Bene | 53/168 |
| 4,914,891 | A | | 4/1990 | Suolahti | |
| 5,042,272 | A | * | 8/1991 | Furr | 242/598.2 |
| 5,282,347 | A | | 2/1994 | Cleine et al. | |
| 5,524,415 | A | * | 6/1996 | Pachinger et al. | 53/168 |
| 5,755,083 | A | | 5/1998 | Cleine | |
| 6,192,653 | B1 | | 2/2001 | Maekawa et al. | |
| 6,195,961 | B1 | * | 3/2001 | Turfan | 53/588 |
| 6,520,445 | B2 | * | 2/2003 | Araujo | 53/588 |

FOREIGN PATENT DOCUMENTS

| | | | | |
|---|---|---|---|---|
| EP | 0 293 352 A2 | | 11/1988 | |
| EP | 0 936 141 B1 | | 8/1999 | |
| GB | 1141832 | | 2/1969 | |
| JP | 02180119 A | * | 7/1990 | B65B/41/16 |

* cited by examiner

*Primary Examiner*—Stephen F. Gerrity
(74) *Attorney, Agent, or Firm*—Darby & Darby

(57) ABSTRACT

A wrapping device provides at least a circular track structure which forms a closed track, and a film feeding device which is arranged to circulate along the track and to feed a film around a piece to be wrapped. The film feeding device includes a frame structure with a rotatable film roll and a feeding mechanism through which the film is arranged to be fed at a desired film tension. The frame structure can be disconnected from and reconnected to the film feeding device for the change of the film roll, and for the change of the film roll, the wrapping device also includes an automatic change system for the change of the frame structure. The frame structure is an integrated unit which can be independently disconnected from and reconnected to the film feeding device. The carriage device of the wrapping device is intended to carry along the film feeding device, and it includes several carriages placed one after the other and coupled to each other, wherein at least one the frame structure is placed or can be placed in one or more carriages.

26 Claims, 3 Drawing Sheets

FILM FEEDING DEVICE AND AN AUTOMATIC WRAPPING DEVICE

FIELD OF THE INVENTION

The invention relates to a wrapping device. The invention also relates to a film feeding device. The invention also relates to a carriage device for a wrapping device.

BACKGROUND OF THE INVENTION

For the wrapping of various pieces, for example coils, wrapping devices known as such are used to perform the wrapping by means of a wrapping film, preferably a thin and transparent stretch film made of plastic. The film roll is normally fitted in film feeding means, which are further placed in a carriage moving along a circular structure and a track formed therein, either around the whole piece or passing through an opening in the central line of the piece.

One wrapping device is disclosed in EP 0 936 142 A2, or corresponding U.S. Pat. No. 6,192,653. If the film is slackened, the film roll can rotate in the opposite direction and the film is rewound on the film roll. Another device is shown in EP 0 936 141 B1, in which the film roll is rotated by means of a motor. One known device is presented in the publication EP 0 544 312 B1, or corresponding U.S. Pat. No. 5,282,347. The device comprises a roll device placed in a carriage and in which the loose film can be accumulated, if necessary.

A problem of prior art is also the change of the film roll, which is a slow operation and requires special structures in the wrapping device.

One example of exchanging the film roll is presented in U.S. Pat. No. 5,755,083, in which the whole film feeding device, i.e. the film carriage, is changed. The problem is, however, the cutting of the circular track and the transfer mechanisms related to it, as well as the slowness of the change. Another alternative to change the film roll is presented in U.S. Pat. No. 4,914,891. The application of this system in a separate film carriage requires a large number of various actuators in the film carriage, increasing its weight and size. Energy supply to a separate, moving film carriage is more difficult than in the device of the reference publication. In view of automatic operation, the correct placement of the film between the guide rolls is a critical step, and its implementation in a reliable manner by using a large variety of guide roll alternatives is difficult.

SUMMARY OF THE INVENTION

It is an aim of the invention to present a system in which the change of the film roll is implemented in a way which accelerates the change to a great extent. By means of the invention, it is possible to change the film roll automatically. In particular, the film feeding device is designed for easy replaceability in view of both the film feeding device and the drive motor. Thanks to the invention, it is also possible to combine a desired number of film rolls in the same system and the change of the film roll is still quick and easy. The structure of the film carriage is simple, and the drive motor can be placed separately from the rest of the device, for example from the film roll to be replaced and the guide rolls.

Thanks to the invention, it is easier to design the carriage and to use alternative, even totally new types of structures. With the separate parts of the device, the replaceability is increased and the maintenance as well as the change of parts become easier and faster. A particular advantage is that the film carriage does not need to be completely detached from the circular track structure.

BRIEF DESCRIPTION OF THE DRAWINGS

In the following description, the invention will be described in more detail by using, as an example, an advantageous embodiment of the invention with reference to the appended drawings, in which.

DETAILED DESCRIPTION OF THE INVENTION

Figure 1:
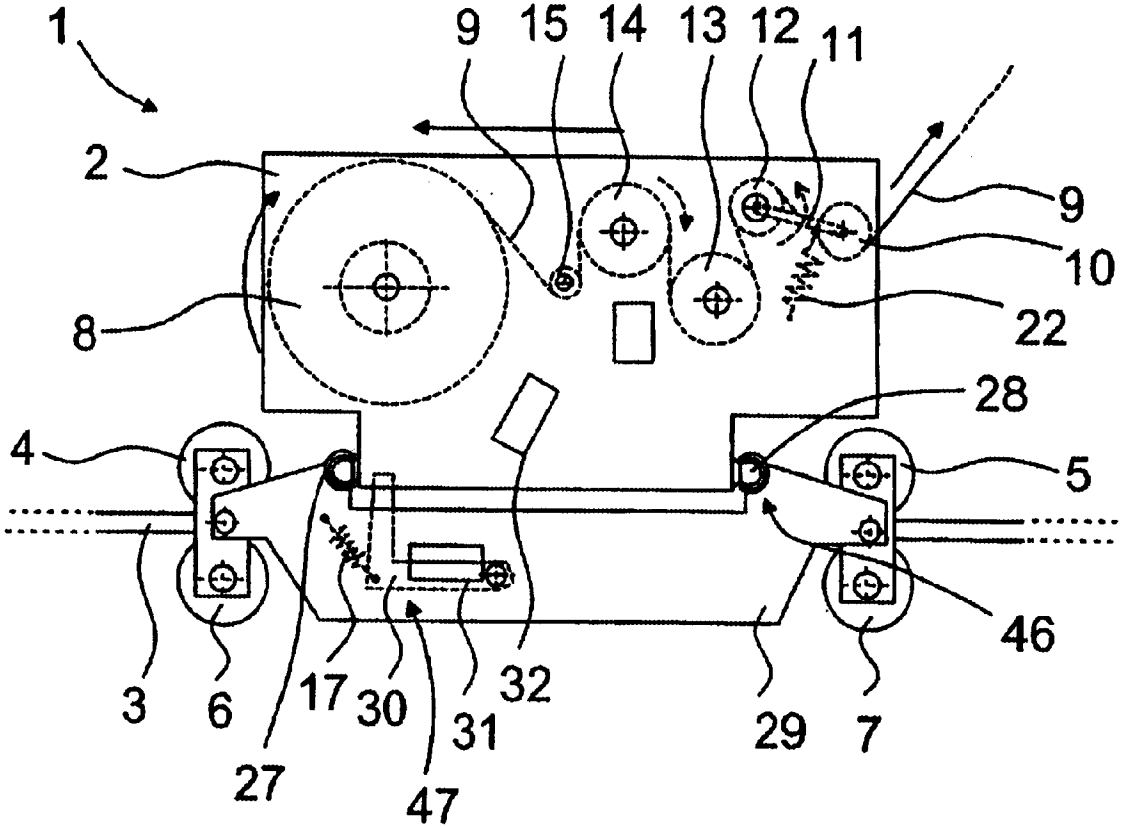
FIG. 1 shows the film feeding device seen from the side and coupled to the track of the wrapping device.

FIG. 1 shows the principle of operation of the film feeding device 1, and in this description, the device 1 will also be called a carriage and the feeding means 10, 12, 13, 14, 15 will also be called guide rolls. The carriage 1 and the guide rolls are shown in a reduced schematic view to illustrate the operation. FIG. 1 shows a situation, in which the film 9 to be fed is suitably tense, wherein the tension of the film is given or higher than that, and it is fed from a film roll 8 forward and further around a piece to be wrapped. The end of the film 9 is attached to the piece, wherein when the carriage 1 moves, the film 9 is simultaneously tightened by the effect of the guide rolls and is unwound from the film roll 8.

One phenomenon in the wrapping device is that the quantity of film to be supplied from the film roll varies each time at different locations of the circular tract, because the carriage is not continuously at the same distance from the piece. At some points, the distance is even reduced, which has the result that the film between the piece and the carriage does not remain sufficiently tensioned all the time. One solution is to feed the slackened film back around the film roll 8. The frame 2 can also be provided with means for this purpose, wherein they can be guide rolls to accumulate the film 9 or a drive mechanism to rotate the film roll 8 in the desired direction. In this case, the frame 2 is also provided with means to detect the tension of the film 9 and to control the drive mechanism.

The carriage 1 comprises a frame structure 2 to which the functional parts are connected, and a separate transfer part 29 with which the frame structure 2 moves. The presented carriage 1 is shown without a motor or means by whose force effect the carriage 1 is moved along the track structure 3 and following a desired path. The track 3 is a circular track forming an endless path along which the carriage 1 travels. The track 3 has, for example, such a shape that it comprises two horizontal track parts which are on top of each other and which are connected by means of vertical arch-like track parts, wherein during a cycle, the carriage 1 rotates around a direction which is horizontal and transverse to the plane in which the carriage 1 moves. The carriage 1 is supported to the track 3 by means of upper wheels 4 and 5 and lower wheels 6 and 7 in the transfer part 29, supporting the carriage 1 in its different positions. The wheels are placed on opposite sides of the track structure 3. The track 3 is, for example, a flat plate structure supported or connected to a frame of its own.

The frame 2 of the carriage 1 is provided with a film roll 8 from which the film 9 is fed and guided by guiding rolls off the carriage 1 and further around the piece to be wrapped, which is placed inside the circular track or through which the carriage 1 and the track 3 are set to pass. In this case, particularly coils made of a metal band, having a large inner opening, are feasible. If necessary, the track is provided with a port which can be opened or with several movable parts so that the track 3 could be inserted in the piece to form a continuous track for the carriage 1. Furthermore, a rotator is placed under the track structure 3 to rotate the coils during the wrapping, wherein each part of the coil can be wrapped. The rotation axis of the coil is its longitudinal axis which is placed in parallel with the track.

The guide rolls of the frame 2 are used to keep the film 9 suitably tensioned by braking and to take care of the pre-tensioning and guiding of the film. In the presented embodiment, the guide rolls also comprise a cam roll 10 which is guided by a spring 22 and whose position also depends on the tension of the film 9. The cam roll 10 is coupled to a rotatable lever 11 whose other end is connected to the rotation axis of the roll 12 or in another fixed position. The roll 12 is freely rotatable.

The guide rolls also comprise a free roll 15 which guides the film 9 unwound from the film roll 8. Rolls 13 and 14 are provided between the rolls 12 and 15. The roll 13 cooperates with the braking roll 14, because they are coupled to each other by a transmission, wherein they rotate in synchronization with each other. The transmission is preferably implemented by means of cogged wheels placed at the ends of the rolls, around the shaft. The locations of the rolls 12, 13, 14 and 15, as well as of the film roll are fixed in relation to each other in the frame 2.

The surface of the track 3 can be roughened or provided with a suitable embossing to prevent the sliding or slipping of the wheels or the drive roll of the drive motor. Thus, the track 3 can also be equipped with a cogging, against which the corresponding cogging of the rolls or wheels is placed. The track 3 can also be coated with a suitable material, such as rubber, to achieve greater friction.

The film roll 8 is mounted on its rotation axis preferably in such a way that the film roll which has become empty can be easily replaced with a new, full film roll. The distance between the rolls 13 and 14 can be preferably set to enable controllability. In one embodiment, the frame 2 comprises two parallel plates between which the guide rolls 12, 13, 14 and 15 are mounted on bearings at each end. Between the plates, there may be connecting structures to support and reinforce the structure. When looking at FIG. 1, only the front plate is visible, the guide rolls and other structures being outlined by broken lines behind it. FIG. 1 does not show, for example, the drive mechanism or the accumulating guide rolls. The shaft supporting the film roll 8 is, in turn, mounted on bearings in only one of the plates, wherein the opposite plate is provided with an opening, through which the film roll 8 can be replaced. Consequently, the carriage 1 is provided with means which enable the fixing of the film roll 8 in the carriage in a replaceable and rotatable manner. The length of the rolls 10, 12, 13, 14, and 15 is equal to or greater than the width of the film 9.

The drive mechanism rotating the film roll 8 can also be replaced by a device of prior art which comprises a set of moving guide rolls which accumulate the loose film. When the replaceable frame 2 comprises the rolls 10, 12, 13, 14, and 15, it will not be necessary to thread the film 9 during the change or to release the guide rolls. The end of the film 9 is continuously held elsewhere in the wrapping device which often comprises automatic means for holding the end of the film, for cutting the film and for guiding it to the piece to be wrapped.

In one embodiment, the number of upper and lower wheels totals eight, wherein they are placed close to each edge of the track 3 and on opposite sides of the track 3. In the presented embodiment, the width of the track 3 corresponds substantially to the width of the carriage 1. Each plate is provided with four wheels, and the lower wheels are connected to the transfer part 29 by means of such structures which extend around the edges of the track 3. The mounting of the rolls and wheels on bearings and their installation are implemented by utilizing mechanical components which are known as such and whose application in the principle of the carriage 1 of FIG. 1 will be obvious on the basis of this description for a person skilled in the art.

The carriage 1 of FIG. 1 is shown without a motor or means by whose force effect the carriage 1 is moved along the track structure 3 and following a desired path. The drive motor for moving the carriage 1 forward can be placed in the frame 2 or in the transfer part 29. The motors or the means for moving the carriage forward can be implemented in ways known as such, wherein the frame 2 or the transfer part 29 is provided with, for example, an electrical motor to rotate a cogged wheel placed against the cogging in the track 3, or a friction wheel pressed against the track 3. By means of the wheel, the carriage 1 is driven forward, and simultaneously the necessary electrification is provided by means of sliding connections, wherein the carriage 1 is provided with contacts and the track 3 is provided with an electrified conductor track, along which the contacts of the carriage slide. The contacts are preferably placed in the transfer part 29 which is not detached from the track 3. If the motor is placed in the replaceable frame 2, there must be a suitable electrical connection between the frame 2 and the transfer part 29 which is disconnected when the frame 2 is removed from the transfer part 29 and reconnected when the frame 2 is brought back. Via the same connection, an electrical current can also be supplied to other actuators placed in the frame 2.

As shown in FIG. 1, the frame 2 and the transfer part 29 are separate units which can be detached from each other. A reason for the detachment is, particularly in automatic wrapping, the change of the film roll 8, wherein a finished film roll must be replaced with a new film roll so that wrapping can be performed in an unmanned manner for even long times and automatically. For the detachment, the frame 2 and the transfer part 29 are provided with a compatible guide system 46, by means of which the frame 2 is moved and placed on the transfer part 29. At the same time, the guide 46 fixes the frame 2 in its position in the vertical direction and the carriage 1 in the moving direction, and a locking 47 prevents the movement in the lateral direction.

In the presented embodiment, the guide system 46 comprises two guides 27 in the frame 2 and the respective counterparts 28 in the transfer part 29. In the presented embodiment, the frame 2 moves to the side in relation to the travel direction of the carriage 1, wherein the automatic change system can be easily implemented by the side of the track 3. In the implementation of the guide 46, it is also possible to apply other types of guides, various wheels, slide surfaces or surfaces fitted to each other, according to the need. The aim is to detach the frame 2 from the transfer part 29, to re-lock it into it, and to transfer it in the desired way, wherein it is possible to apply components known as such.

The frame 2 is locked in its position by means of a locking 47 which comprises, for example, a movable lever 30 in the transfer part 29, which extends to the frame 2 to achieve the locking and is kept locked by a spring 17. The lever 30 can also be placed in the frame 2. If necessary, the lever or the locking will place the frame 2 in its correct final position. The automatic change system comprises a protrusion which is positioned at an opening 31 and inserted in the transfer part 29, wherein the protrusion pushes the lever 30 downwards and releases the locking. The same principle can also be applied in connection with the drive mechanism of the film roll and other such structures which must be transferred to a given position for the time of the change of the frame 2 so that they would not collide with the track 3 or the transfer part 29. For this purpose, the frame 2 is also provided with one or more openings 32. The protrusion can also be used to release electrical connections.

Figure 2:
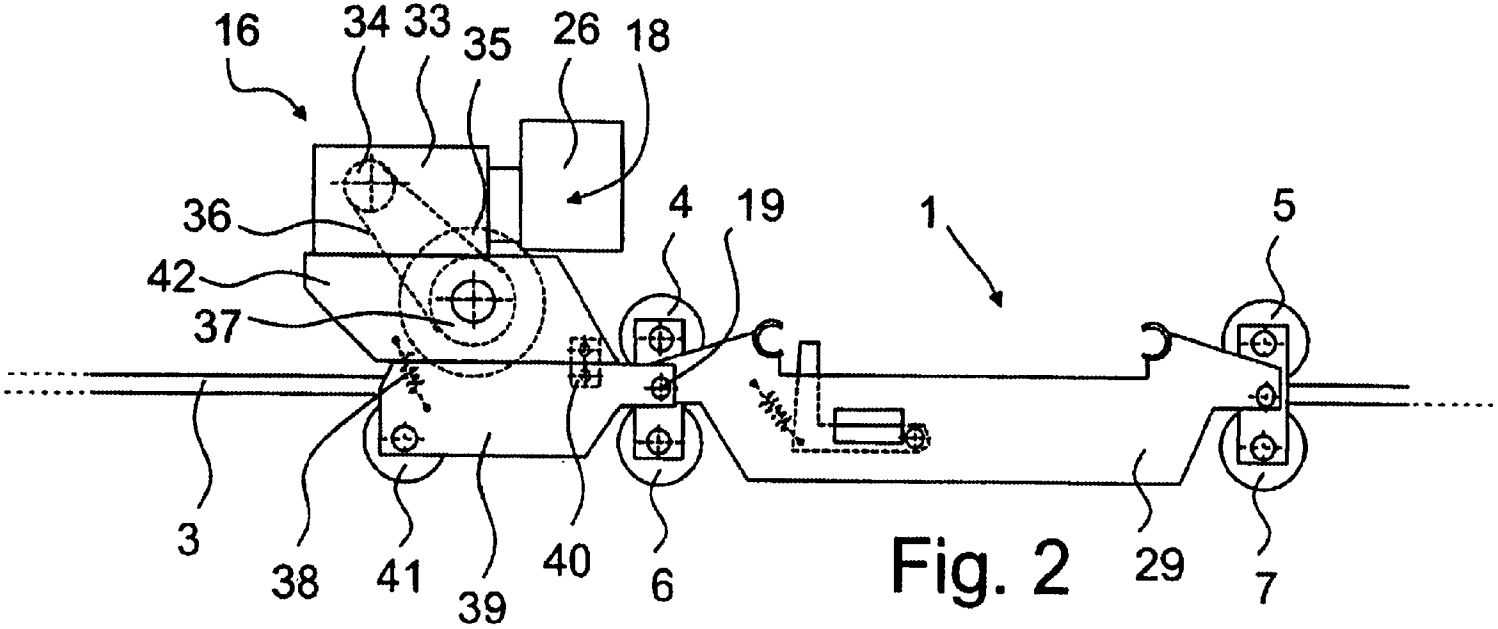
FIG. 2 shows the carriage device seen from the side and coupled to the track of the wrapping device.

In an advantageous embodiment of the invention, the carriage 1 is conveyed by means of a separate pulling carriage 16 shown in FIG. 2, which is also called a tractor, in which the necessary drive motor means 18 are placed. The means comprise, for example, an electrical motor 26, a gearing 33 to rotate a belt pulley 34 which, in turn, rotates, via a cogged belt 36, a drive wheel 37 which is pressed against the track 3 and drives the pulling carriage 166 forward by means of friction. The pulling carriage 16 is provided with a lower wheel 41, and the drive wheel 37 is connected to a frame 42 which is connected by means of a joint 40 to the lower part 39 of the frame of the pulling carriage 16. A spring 38 is used to help in the pressing of the drive wheel 37 against the track 3. As already stated above, the drive wheel 37 can be replaced with a cogged wheel. The pulling carriage 16 is connected by means of a joint 19 to the carriage 1, wherein the joint 19 is preferably in the transfer part 29, between the wheels 4 and 6. If necessary, the joint 19 makes a simple change of the pulling carriage 16 possible. The joint 19 also makes it possible that the combination of the pulling carriage 16 and the film roll carriage 1 bends at curved sections of the track 3, wherein the track 3 may also be small. At the same time, the structure of the carriage 1 can be lowered, because the motor can be placed in front of the carriage 1, but the length of the structure will still not cause problems in tight bends of the track.

Figure 3:
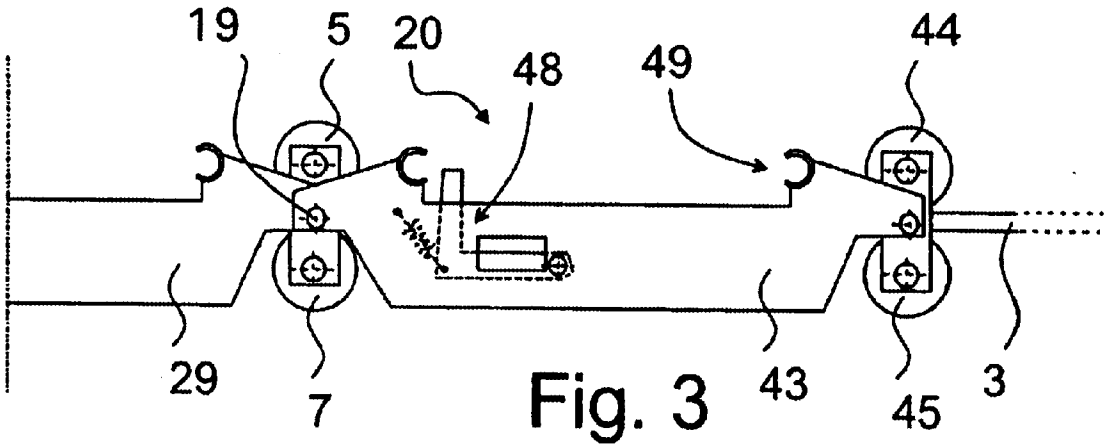
FIG. 3 shows the carriage device of FIG. 2, which comprises several carriages to which the film feeding device can be connected.

FIG. 3 shows yet another advantageous embodiment of the invention, in which one or more film roll carriages 20 are connected at the end of the carriage 1, and these are also equipped in view of the change of the frame 2, shown in FIG. 1, wherein the corresponding frame is placed on top of the transfer part 43. The device consists of a carriage system, a required number of carriages 1 and 20 being connected in a sequence, wherein one or more carriages have at least one of the frame structures 2 presented above. Preferably, the device also has a separate carriage for motor means, as in FIG. 2, but the drive motor may also be integrated in one of the carriages. The carriage 1 and the carriage 20 are preferably identical, particularly in view of the guides 49, wherein the same automatic change system is also suitable for the carriage 20, and the frame 2 of FIG. 1 can also be placed in the carriage 20. The carriage 20 comprises an upper wheel 44 and a lower wheel 45 corresponding to the wheels 5 and 7 of the carriage 2 with respect to their structure and placement. There are no front wheels in the carriage 20, but the carriage 20 is connected by means of the joint 19 to the transfer part 29, wherein the wheels 5 and 7 carry both the transfer parts 29 and 43. The transfer part 43 also has a locking system 48 of a similar type. The embodiment of the invention shown in FIG. 3 makes it possible to wrap several films, of the same or different type, simultaneously around the piece. One film may be a conventional plastic film and one film may be a thicker film used as a cushion or protection.

Figure 4:
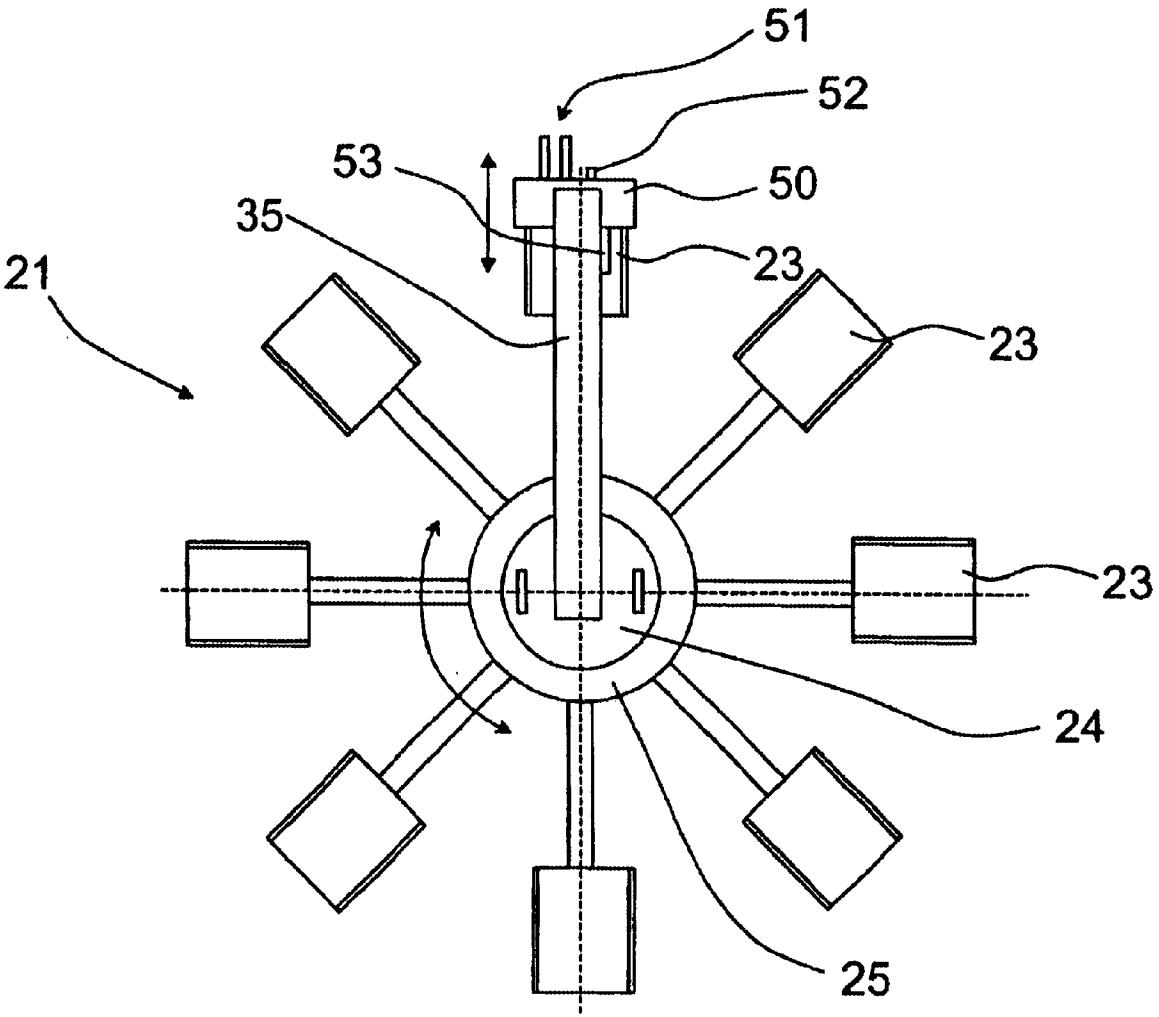
FIG. 4 shows a top view of an automatic change system for the wrapping device.

FIG. 4 shows an automatic change system 21 which is placed at the circular track structure 3 and is intended to process frames 2 according to FIG. 1. The system 21 is of a carousel type comprising trays placed in an annular array or other connections 23 for several frames 2. The storage locations 23 may be provided with guides similar to those in the transfer part, wherein the frame 2 can be pulled into its position after the storage location is positioned at the carriage 1. The system 21 either stands or is suspended by means of its frame 24, to which the carousel 25 is rotatably mounted on bearings. Preferably, the system 21 is placed in such a way that the carriage 1 must be driven to the uppermost point of the track 3 for the change, wherein it is upside down, and the frame 24 is suspended, wherein transfer devices for the pieces to be wrapped can be placed underneath. A transfer device 50, which comprises frames 2, is connected to a horizontal guide 35, along which it moves and which is connected to the frame 24 in a rotating manner, if necessary. The transfer device 50 comprises protrusions 51 by means of which it grips the frame 2 and processes it in a desired manner. If necessary, the protrusions 51 can be controlled by actuators for the connection, and they are, for example, jaws which grip the frame 2. The transfer device 50 also comprises a protrusion 52 to release the locking and which is transferred by an actuator 53 which is, for example, a pneumatic cylinder. The guide 35 or the device 50 is arranged to move also in the vertical direction, if necessary. The operation of the protrusion 52 may be synchronized with the movement of the device 50, if the locking is to be kept released during the transfer of the frame 2. Alternatively, the actuator 53 is integrated in the guide 35, separate from the device 50, for independent operation.

The carousel 25 may also be replaced with a set of racks, in which the frames 2 are placed by means of the device 50 in two or more levels. The device 50 is thus movable in the horizontal and vertical directions, and it moves the frames 2 to and from the rack. The racks can be provided with a guide system corresponding to-the transfer part 29, and a locking. Depending on the direction of the rack set, either the device 50 and/or the guide 35 may also be rotatable in the vertical direction. The change system 21 may also be constructed in such a way that the device 50 is used to remove or return frames 2 by using one fixed storage location, but the system also comprises an elevator system to transfer the frames to and from the rack. In this case, it is also possible to apply conveyors in the transfer of the frame 2 between the device 50 and the elevator system.

The invention is not limited solely to the advantageous embodiment presented above, but it may vary within the scope of the appended claims.

What is claimed is:

1. A wrapping device comprising at least a circular track structure which forms a closed track, and a film feeding device which is arranged to, circulate along said track and to feed a film around a piece to be wrapped, wherein the film feeding device comprises a frame structure which is provided with at least:

means for fixing a film roll in said frame structure in a rotating manner, and feeding means, through which the film is arranged to be fed at a desired film tension, wherein:

said frame structure can be disconnected from and reconnected to the film feeding device for the change of the film roll, and for the change of the film roll, the wrapping device also comprises an automatic change system for the change of said frame structure.

2. The wrapping device according to claim 1, wherein said frame structure is also provided with a drive mechanism which is arranged to rotate the film roll in a direction in which the film is rewound on the film roll.

3. The wrapping device according to claim 1, wherein the film feeding device comprises a guide system, by means of which said frame structure can be moved.

4. The wrapping device according to claim 3, wherein the film feeding device is provided with a locking system which is intended for locking said frame structure in its position.

5. The wrapping device according to claim 1, wherein said frame structure can be moved in a direction which is substantially perpendicular to the travel direction of the film feeding device as well as to the plane in which the film feeding device is arranged to circulate said track.

6. The wrapping device according to claim 1, wherein the film feeding device is provided with a locking system which is intended for locking said frame structure in its position.

7. The wrapping device according to claim 6, wherein said change system is arranged to release said locking system for the time of the change.

8. The wrapping device according to claim 1, wherein said change system is arranged to move devices in the frame structure or in the film feeding device in a desired position, wherein the aim is to move the devices in a position in which they do not collide with the track structure, the frame structure or the film feeding device during the change.

9. The wrapping device according to claim 8, wherein said change system comprises extending means which can be inserted in the film feeding device through openings therein.

10. The wrapping device according to claim 1, wherein said change system comprises extending means which can be inserted in the film feeding device through openings therein.

11. The wrapping device according to claim 1, wherein the wrapping device also comprises a storage in which several frame structures can be placed for the change.

12. The wrapping device according to claim 11, wherein said storage comprises a rotatable carousel, whose circumference is provided with several storage locations for said frame structures.

13. The wrapping device according to claim 11, wherein said change system also comprises a transfer device which is arranged to grip the frame structure and to move it from and to the film feeding device.

14. The wrapping device according to claim 1, wherein said change system also comprises a transfer device which is arranged to grip the frame structure and to move it from and to the film feeding device.

15. The wrapping device according to claim 1, wherein several said frame structures, which are separate, can be placed in the film feeding device.

16. The wrapping device according to claim 15, wherein the wrapping device comprises several film feeding devices placed one after the other and coupled to each other, and at least one said frame structure can be placed in each film feeding device.

17. The wrapping device according to claim 1, wherein the wrapping device comprises several film feeding devices placed one after the other and coupled to each other, and at least one said frame structure can be placed in each film feeding device.

18. The wrapping device according to claim 17, wherein the wrapping device comprises a pulling carriage which is coupled to the film feeding device and which is arranged to circulate said track, wherein motor means for driving the film feeding device along said track are placed in said pulling carriage.

19. The wrapping device according to claim 1, wherein the wrapping device comprises a pulling carriage which is coupled to the film feeding device and which is arranged to circulate said track, wherein motor means for driving the film feeding device along said track are placed in said pulling carriage.

20. A film feeding device for a wrapping device, comprising a frame structure which is provided with at least:

means for fixing a film roll in said frame structure in a rotating manner, and feeding means, through which the film is arranged to be fed at a desired film tension around a piece to wrapped, wherein said frame structure is an integrated unit which can be independently disconnected from and reconnected to the film feeding device.

21. The film feeding device for a wrapping device according to claim 20, wherein the connection of said frame structure in the film feeding device is arranged for the automatic change of said frame 20 structure.

22. A carriage device for a wrapping device, which is arranged to travel along a track structure belonging to the wrapping device and intended to carry along a film feeding device which comprises a frame structure which is provided with at least:

means for fixing a film roll in the film feeding device in a rotating manner, and feeding means, through which the film is arranged to be fed at a desired film tension around a piece to wrapped, wherein the carriage device comprises several carriages placed one after the other and coupled to each other, wherein at least one said frame structure is placed or can be placed in one or more carriages, wherein said at least one frame structure can be disconnected from and reconnected to the film feeding device for the change of the film roll.

23. The carriage device according to claim 22, further comprising a pulling carriage which is connected to the other carriages, wherein said pulling carriage is provided with motor means for moving the drive mechanism along said track.

24. The carriage device according to claim 23, wherein in at least one carriage, the connection between the carriage and said frame structure is arranged for the automatic change of said frame structure.

25. The carriage device according to claim 22, wherein said carriages are coupled to each other by means of a joint.

26. A carriage device for a wrapping device, which is arranged to travel along a track structure belonging to the wrapping device and intended to carry along a film feeding device which comprises a frame structure which is provided with at least:

means for fixing a film roll in the film feeding device in a rotating manner, and feeding means, through which the film is arranged to be fed at a desired film tension around a piece to wrapped, wherein the carriage device comprises several carriages placed one after the other and coupled to each other, wherein at least one said frame structure is placed or can be placed in one or more carriages, wherein in at least one carriage, the connection between the carriage and said frame structure is arranged for the automatic change of said frame structure.

* * * * *